US007448322B2

(12) United States Patent
Faist

(10) Patent No.: US 7,448,322 B2
(45) Date of Patent: Nov. 11, 2008

(54) ROLLER CLOSING DEVICE WITH AN INNER AND OUTER PART

(75) Inventor: Bernd Klaus Faist, Ochsenfurt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 365 days.

(21) Appl. No.: 10/558,485

(22) PCT Filed: May 14, 2004

(86) PCT No.: PCT/EP2004/050807

§ 371 (c)(1),
(2), (4) Date: Nov. 28, 2005

(87) PCT Pub. No.: WO2004/103704

PCT Pub. Date: Dec. 2, 2004

(65) Prior Publication Data

US 2007/0006756 A1 Jan. 11, 2007

(30) Foreign Application Priority Data

May 26, 2003 (DE) ..... 103 23 555
Sep. 18, 2003 (DE) ..... 103 43 580

(51) Int. Cl.
*B41F 5/00* (2006.01)

(52) U.S. Cl. ..... 101/352.01; 101/148; 101/217; 101/218; 101/248; 101/352.05

(58) Field of Classification Search ..... 101/216, 101/217, 218, 212, 247, 352.01, 357, 358; 492/4

See application file for complete search history.

(56) References Cited

U.S. PATENT DOCUMENTS

| | | | | |
|---|---|---|---|---|
| 3,456,993 | A | 7/1969 | Muller | |
| 4,455,727 | A | 6/1984 | Tschirner | |
| 4,928,589 | A * | 5/1990 | Schofield | 100/170 |
| 5,003,863 | A | 4/1991 | Schiel et al. | |
| 6,360,664 | B1 * | 3/2002 | Gottling et al. | 101/481 |
| 6,761,112 | B2 * | 7/2004 | Faist et al. | 101/247 |
| 7,021,209 | B2 * | 4/2006 | Faist et al. | 101/216 |
| 7,117,792 | B2 * | 10/2006 | Faist et al. | 101/352.05 |
| 7,124,683 | B2 * | 10/2006 | Faist et al. | 101/247 |
| 2004/0112232 | A1 | 6/2004 | Faist et al. | |

FOREIGN PATENT DOCUMENTS

| | | |
|---|---|---|
| DE | 1 257 090 | 12/1967 |
| DE | 1 561 014 | 2/1970 |

(Continued)

*Primary Examiner*—Judy Nguyen
*Assistant Examiner*—Leo T Hinze
(74) *Attorney, Agent, or Firm*—Jones, Tullar & Cooper, PC

(57) ABSTRACT

A roller closing device is provided with an inner element and with an outer element. These two elements are arranged at least partially in a coaxial manner. The inner element can be deflected radially with respect to the outer element by the use of at least one elastic body which is arranged between the two elements. This elastic body is configured as a rolling diaphragm. A seal is configured between the inner element and the outer element. The seal closes off a gap between the two elements to prevent impurities from entering the roller closing device when any radial deflection of the inner element takes place.

75 Claims, 9 Drawing Sheets

FOREIGN PATENT DOCUMENTS

| | | | |
|---|---|---|---|
| DE | 31 05 171 | A1 | 8/1982 |
| DE | 39 10 827 | A1 | 11/1989 |
| DE | 42 31 673 | A1 | 3/1994 |
| DE | 101 13 313 | A1 | 9/2002 |
| GB | 719 289 | | 12/1954 |
| GB | 1 213 903 | | 11/1970 |
| GB | 2 271 082 | | 4/1994 |
| WO | WO 02/074542 | A2 | 9/2002 |
| WO | WO 02/074542 | A3 | 9/2002 |

* cited by examiner

Schnitt A-A

Schnitt B-B

ROLLER CLOSING DEVICE WITH AN INNER AND OUTER PART

CROSS-REFERENCE TO RELATED APPLICATIONS

This patent application is the U.S. national phase, under 35 U.S.C. 371, of PCT/EP2004/050807, filed May 14, 2004; published as WO 2004/103704 A2 and A3 on Dec. 2, 2004 and claiming priority to DE 103 23 555.8, filed May 26, 2003 and to DE 103 43 580.8 filed Sep. 18, 2003, the disclosures of which are expressly incorporated herein by reference.

FIELD OF THE INVENTION

The present invention is directed to roller closing devices with an inner and outer element. The inner element and the outer element are arranged coaxially, at least in part, and at least one elastic body is arranged between the inner element and the outer element.

BACKGROUND OF THE INVENTION

Inking systems or dampening systems, for use in printing presses, are used for conveying the printing ink that is required for the printing process or for conveying the required dampening agent from appropriate supply devices to the printing zone. Rollers or cylinders are provided in the inking system or in the dampening system for forming the ink film or the moisture film required for this. The terms roller and cylinder will be understood to have the same meaning in connection with an understanding the present invention. The rollers come to rest against each other at roller strips, so that the ink film or the moisture film can be transferred from one roller to another roller in the area of these roller strips. Rollers which are displaceably seated in a machine frame, are provided in connection with such inking systems or dampening systems. By displacement of these displaceably seated rollers, in relation to the other rollers, it is possible to change the contact pressure in the roller strips.

A roller seating which is adjustable only in one direction is known from DE 15 61 014 C1, and is intended for use, in particular, for distributing and for application rollers of inking systems in printing presses. Adjusting mechanisms for displacing the roller transversely in respect to its axis are provided. The adjusting mechanisms are attached between a bearing journal, which is connected with the frame wall, and a housing, which receives a roller end and which is preferably configured in a cup shape. The bearing journal and the housing are connected with each other by spring elements which act counter to the adjusting means. In this case, the spring elements are preferably configured as radially extending rubber bumpers and the adjusting mechanisms acting on the bearing journals are provided either as a radially arranged adjustment screw or as two adjustment screws that are arranged at 45° in relation to each other. In accordance with a further embodiment of this prior device, moving the roller in and out of contact, and therefore accomplishing the adjustment of the roller seating, can also take place by the use of two pressure chambers, which are arranged diametrically in the interior of the housing and which can be charged with air or a fluid. The counter-acting pressure chambers are selectively charged with a pressure, depending on the desired direction of their action.

Devices for setting a contact pressure of a displaceably seated roller are known from WO 02/074542 A2 and DE 101 13 313 A1, from which it claims priority. A diaphragm encircling a holder forms four pressure chambers in a gap between the holder and a sleeve surrounding it. The gap between the holder and the surrounding sleeve is open and unprotected in this prior device.

A cylinder-piston unit for use in displacing a roller transversely, with respect to its longitudinal axis, is known from DE 39 10 827 A1. An annular gap exists between the piston, which is embodied as a lifting piston and which is arranged transversely with respect to a longitudinal axis of the roller, and the inner cylinder wall. A stripper ring bridging the annular gap and two units, which are spaced apart from each other in the axial direction of the lifting piston and which seal the annular gap, are each provided with an elastic sealing ring. The stripper ring and the support rings of the sealing rings can be radially displaced in accordance with a transverse displacement of the piston in the cylinder. Thus, the stripper ring and the sealing rings follow the transverse displacement of the piston substantially without changing their shapes.

SUMMARY OF THE INVENTION

The object of the present invention is directed to providing roller closing devices with an inner element and an outer element.

In accordance with the present invention, this object is attained by the provision of a roller closing device which has an inner element and an outer element. These two elements are arranged, at least in part, coaxially. At least one elastic body is arranged between the inner element and the outer element. A deflection of the elastic body exerts a force, which is directed radially, between the inner element and the outer element. The elastic body may be embodied in the form of a diaphragm.

The advantages to be obtained by the use of the present invention reside, for one, in that the roller diaphragm, which preferably is made of an elastomeric material, shows a clearly defined deformation when it is charged with a pressure medium. Because the roller diaphragm has been releasably inserted into a frame, it can be easily exchanged, when needed. A material-to-material contact between the frame and the roller diaphragm, such as, for example, by vulcanizing, by gluing or by similar production processes, is not required. The making of an elastomer-metal connection in particular, which can sometimes be expensive and problematical, is avoided. The roller diaphragm can be produced as a separate component, and without a connection with another component, which has an advantageous effect on its manufacturing costs. The roller diaphragm exerts an even surface pressure on the holder via an intermediate element, which is arranged in a window of the frame. Only the intermediate element, and not the roller diaphragm, has a boundary area toward the holder, so that, in the course of a rotatory displacement of the holder, no friction can occur between the roller diaphragm and the holder. Greasing or lubrication of the roller diaphragm is not required, which adds to the low maintenance of the roller closing device of the present invention. In the course of increased charging of the device with the pressure medium, the chamber that is formed by the roller diaphragm, is sealed more and more tightly against the hollow body surrounding the frame because of an applied sealing lip. Also, an additional separate seal is not required for supplying the pressure medium to the chamber of the roller diaphragm, when the frame with the applied roller diaphragm is flanged to the front of a machine element, for example. A through-hole, that is cut into the roller diaphragm, can be configured in a simple manner to have a seal which rises slightly above the front of the frame. The roller closing device permits manual mounting, because all of the cooperating elements are releasably connected with each other, particularly by being plugged into each other. The preferred configuration of the roller closing device, in accordance with the present invention makes it possible to omit reinforcement, such as, for example, by the inclusion of material woven into the effective surface of the roller diaphragm. It is of particular advantage that a surface between the roller diaphragm and the intermediate element, which is effective for exerting a force, remains constant under all circumstances. This is true even if the intermediate element performs a tilting movement.

The advantages to be gained by the present invention furthermore include that the seal which is provided between the inner element, such as the holder, and the outer element, such as the frame, of the roller closing device seals a gap existing between the inner element and the outer element against the entry of foreign bodies, such as, for example, dust or moisture into the roller closing device in the course of any arbitrary radial deflection of the inner element. This is accomplished without hindering the radial displacement movement of the holder or acting counter to the displacement with a force. In spite of the absence of interaction, the roller closing device, which is intended to operate particularly in the rough environment of a print shop, is hermetically sealed by the seal. The seal thus contributes to a dependable and to an interference-free functioning of the roller closing device and decreases maintenance to be performed on it, which maintenance could require a stop of the entire printing press, and would therefore result in a production loss.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
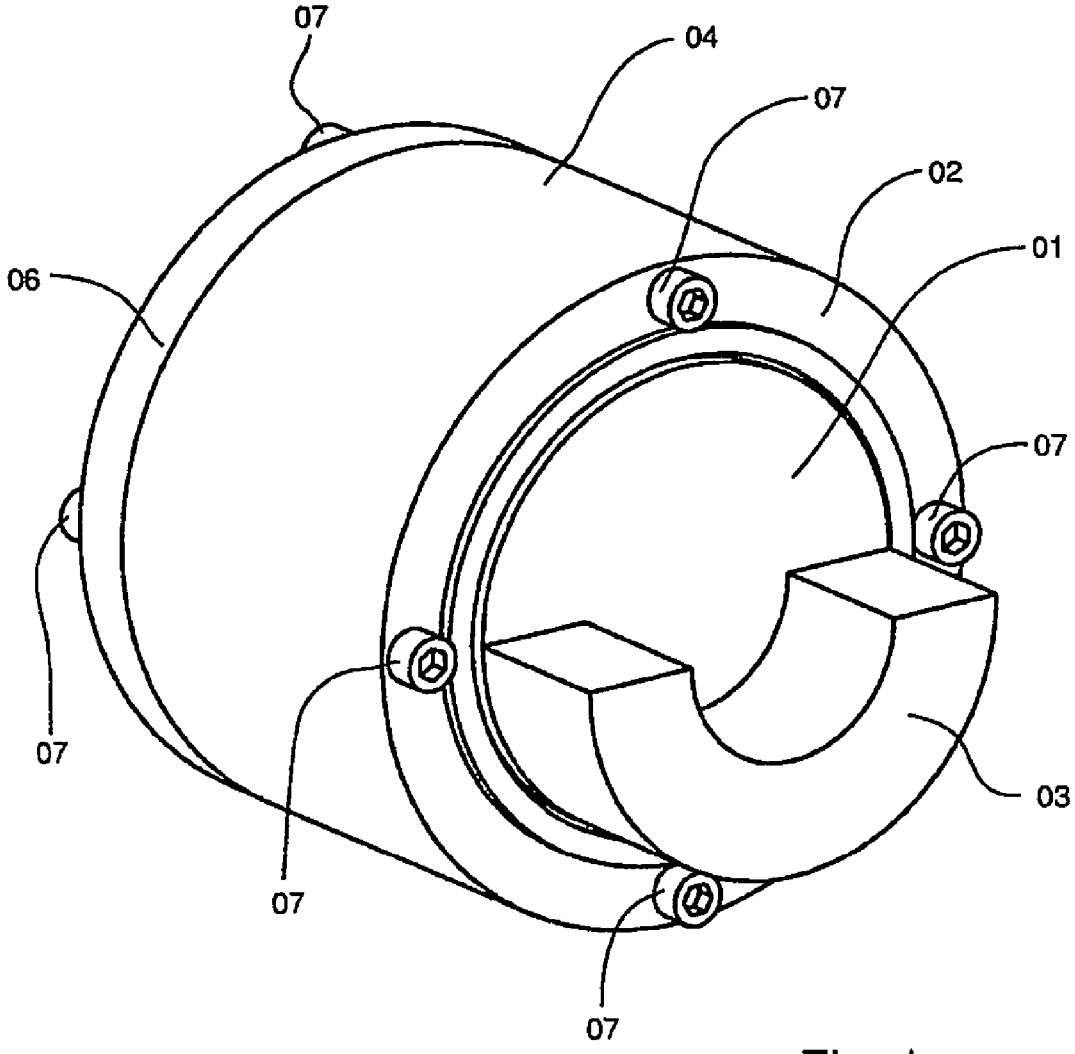
FIG. 1, a perspective representation of a roller locking device in the mounted state, in FIG. 2, a perspective representation of elements of the roller locking device in accordance with FIG. 1, in FIG. 3, a cross-sectional view of the roller locking device in accordance with FIG. 1, FIG. 4, a longitudinal cross-sectional view, taken in the axial direction of the roller locking device in accordance with FIG. 1, in FIG. 5, an enlargement of the encircled individual elements in FIG. 4, in FIG. 6, an exploded perspective view representing a mounting of elements of the roller locking device in accordance with FIG. 1, in FIG. 7, a top plan view of the roller diaphragm, in FIG. 8, a cross-sectional view through the roller diaphragm, in FIG. 9, a longitudinal section through the roller diaphragm, in FIG. 10, a perspective top plan view of the roller diaphragm, in FIG. 11, a perspective bottom plan view of the roller diaphragm, in FIG. 12, a bottom plan view of an intermediate element in accordance with the present invention, in FIG. 13, a cross-sectional view through the intermediate element, in FIG. 14, a perspective plan view of the intermediate element from above, in FIG. 15, a perspective plan view of the intermediate element from below, in FIG. 16, a perspective plan view of a frame of the roller closing device in accordance with the present invention, in FIG. 17, a longitudinal cross-sectional view of the frame represented in FIG. 16, in FIG. 18, a plan view of a detail of an encircled portion of the frame, as represented in FIG. 16, and in FIG. 19, a longitudinal cross-sectional view of a roller closing device in accordance with the present invention.

Referring initially to FIG. 1, there is shown an embodiment of a roller closing device in accordance with the present invention, and wherein it is possible to see, from the perspective representation shown in FIG. 1, that the roller closing device has an inner element 01 and an outer element 02. The outer element 02 is preferably configured as a frame 02. The inner element 01 is preferably configured as a holder 01 which is connected with a roller of a printing press which is not specifically represented. A shell 03, for example, is provided at the front of the holder 01 facing the roller, and into which shell a journal, which is not specifically represented, and which is arranged at a front of the roller, can be inserted and maintained. For example, the roller may be arranged in an inking system or in a dampening system of the printing press. The journal of the roller is preferably fixed against relative rotation, so that the journal does not perform the rotational movement of the roller. Instead, the roller is seated on the journal, in, for example, rotary bearings. In the roller closing device, the frame 02 comprises, at least in its axial direction, the holder 01. In other words, the frame 02 and the holder 01 are arranged coaxially. The frame 02 is preferably seated stationarily in the printing press, in that the frame 02 is fastened on a machine frame of the printing press, for example.

Figure 19:
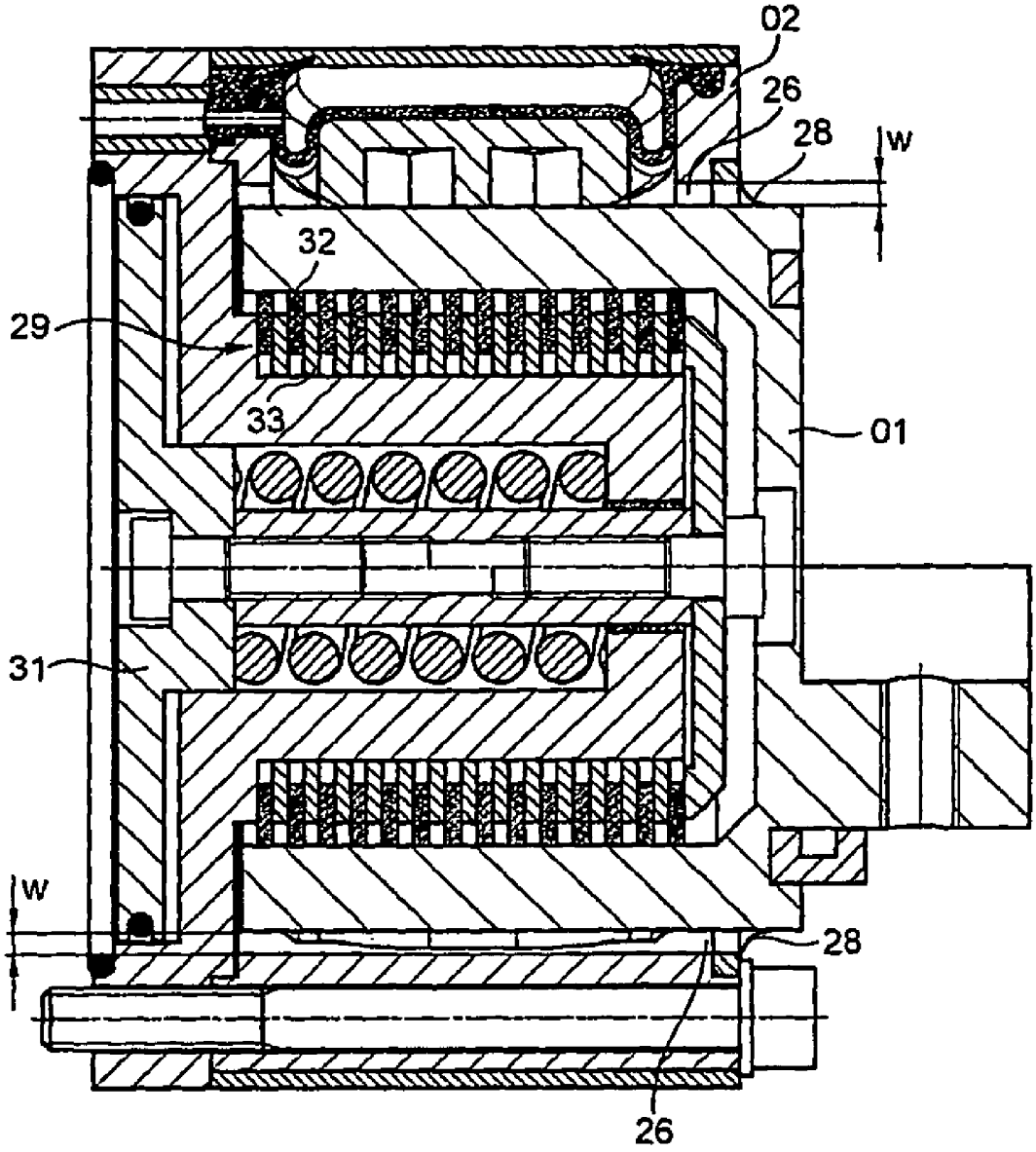

In the frame 02, the holder 01 has a positionally stable, first operating state, in particular an operating state that is fixed against relative rotation, which stable operating state can be released to place the holder 01 into a second state of operation which, inter alia, is also rotatable. The first state of operation wherein the holder 01 is fixed against relative rotation is accomplished, for example, by the use of a fixation arrangement 29, as seen in FIG. 19, which is preferably arranged in the roller closing device, and which, for example, can be pneumatically or electrically actuated by an actuating mechanism 31, and in particular, can be remotely actuated from a control console, which is assigned, for example, to the printing press. The fixation arrangement 29 is, for example, configured as a multiple-disk clutch, wherein first clutch elements 32 are fixed on the holder 01 and second clutch elements 33 are fixed on the frame 02, which second clutch elements 33 are therefore fixed against relative rotation. These clutch elements 32, 33 engage each other by way of frictional or by positive contact. In its second operational state, in which its position can be changed, which second operating state is, as a rule, only intended for a short time, the radial and/or the angular position of the holder 01 in relation to the frame 02 can be changed or can be aligned. A continuous rotation of the holder 01 in the frame 02 is not intended to be the appropriate operational state of the holder 01. Following the release of the fixation arrangement 29, the holder 01 is also slightly axially movable, for example, in the frame 02. This slight axial movement of holder 01 is to the extent necessary for releasing the frictional or the positive connection between the first clutch elements 32 and the second clutch elements 33. Following a realignment of the holder 01, with respect to its radial position in relation to the frame 02, the fixation arrangement 29 is closed again. The holder 01 is now fixed in place in its new angular position in the frame 02 and/or in its new radial position with relation to the frame 02.

Preferably, the frame 02 is surrounded by a, for example, tube-shaped hollow body 04. On its end which is facing away from the roller, the frame 02 has a cover 06, for example. One or several through-holes 08, for example, have been cut into the frame 02, as may be seen in FIG. 2, and through which fastening elements 07, such as, for example, a screw 07, can be pushed for use in mounting the roller closing device and/or for use in fastening the roller closing device on the machine frame of the printing press. The frame 02, as well as the hollow body 04 surrounding it, are preferably each embodied in one piece and/or are each cylindrical.

Figure 3:
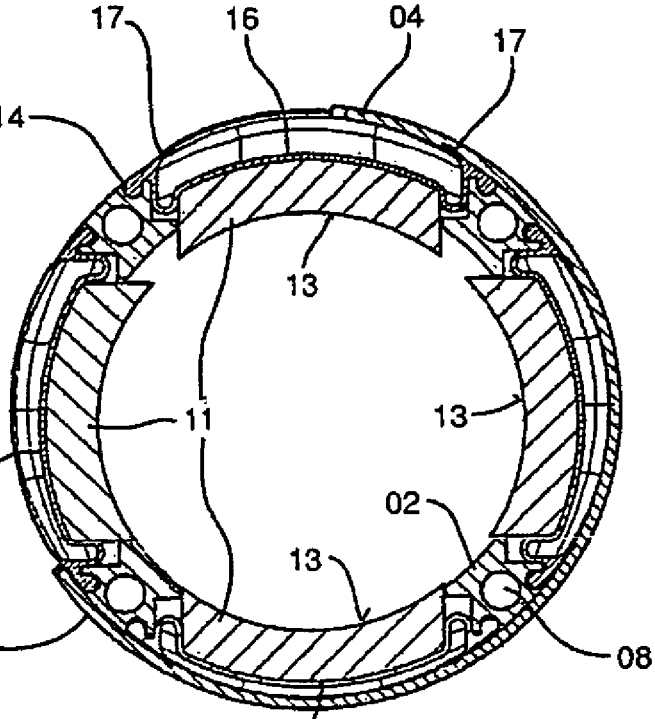
Figure 2:
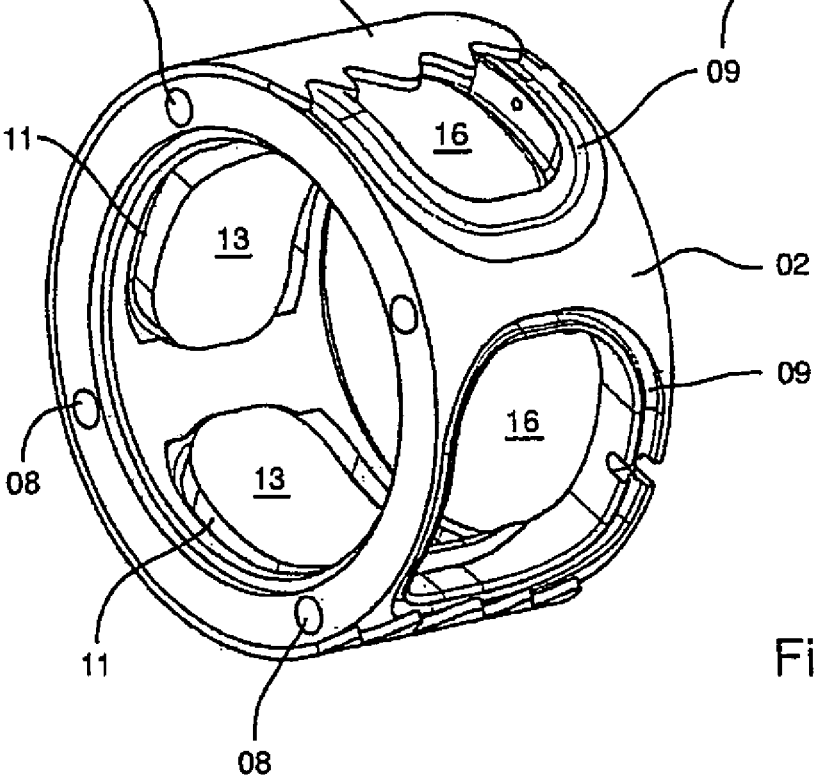
Figure 4:
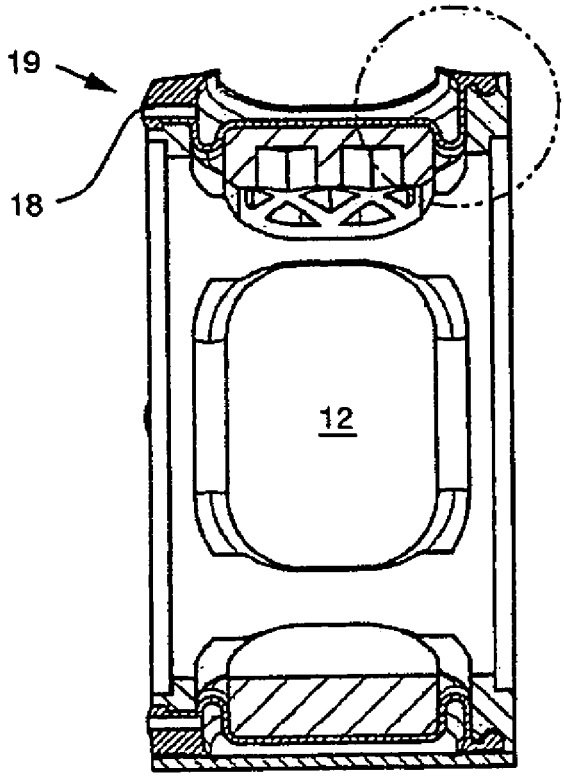

FIG. 2 shows a cylindrical representation of the hollow body 04, as well as the frame 02 of the roller closing device in accordance with FIG. 1. An elastic body 09, which is embodied as a roller diaphragm 09, has been inserted into a window 12, as seen in FIG. 4, which window 12 is cut into the frame 02. The elastic body 09 or roller diaphragm 09 is in effective contact with an intermediate element 11, which element 11 is preferably sturdily constructed in the shape of a plunger. If the frame 02 has several windows 12, these several windows 12 have preferably been cut along the circumference of the frame 02 and preferably are spaced circumferentially at equal distances from each other. Representing a cross section of the roller closing device in accordance with the present invention, FIG. 3 shows that each one of the intermediate elements 11, which is assigned to a respective one of the roller diaphragms 09, is arranged radially between the frame 02 and the holder 01, which holder 01, for reasons of clarity, is not represented in FIG. 2. Preferably, the intermediate element or plunger 11 is enclosed by the roller diaphragm 09. As a function of this, the roller diaphragm 09 can exert a radial force during its deflection, by use of an effective surface 13 of the intermediate element 11, and thus can act, indirectly, on the holder 01. The force which is exerted by the roller diaphragm 09 on the holder 01 adjusts the displacement of the roller connected with the holder 01 in an infinitely variable manner. The displacement of the roller can be, for example, up to 10 mm. The displacement of the roller is preferably directed transversely to is axial direction, so that the displacement of the roller preferably takes place in a plane which is substantially perpendicular with respect to the axial direction of the roller. For example, the intermediate element 11 is laterally guided in the window 12 of the frame 02. The intermediate element 11 is held in, for example, a tiltable manner, in a cross-sectional plane of the frame 02, in the window 12 of the frame 02. On a boundary surface 13 of the intermediate member 11, which boundary surface 13 is facing toward the holder 01, the intermediate element 11 is preferably configured to be slidable. The boundary surface 13 thus constitutes an effective surface 13, in respect to the holder 01. Thus, the roller diaphragm 09 exerts a force on the holder 01 through the windows 12, in the course of which force exertion, the roller diaphragm 09 pushes the intermediate element 11, which is composed of an inelastic and therefore an incompressible material, against the holder 01.

The roller diaphragm 09 is arranged in the frame 02 and is preferably releasably connected with the frame 02. The roller diaphragm 09 can thus be easily exchanged, since it can be removed from the frame 02 without being destroyed. The roller diaphragm 09 is preferably only mechanically tied to the window 12 of the frame 02 and has not been inserted in the window 12 of the frame 02 in a material-to-material-connected manner. Preferably, the roller diaphragm 09 completely closes the window 12. The roller diaphragm 09 has a seal 14 on its rim, which seals the roller diaphragm 09 against the frame 02 and which is preferably embodied as a bead 14, with bead 14 which the roller diaphragm 09 in the window 12 of the frame 02 engages a bead or a channel provided or formed in the frame 02 in a positively connected manner, so that the roller diaphragm 09 is fixed in place in the frame 02. In this case, the bead 14 portion of the roller diaphragm 09 is preferably configured to extend all around the roller diaphragm 09.

Figure 5:
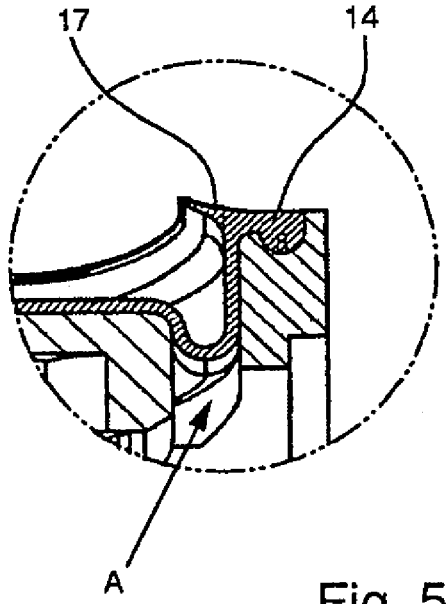
Figure 6:
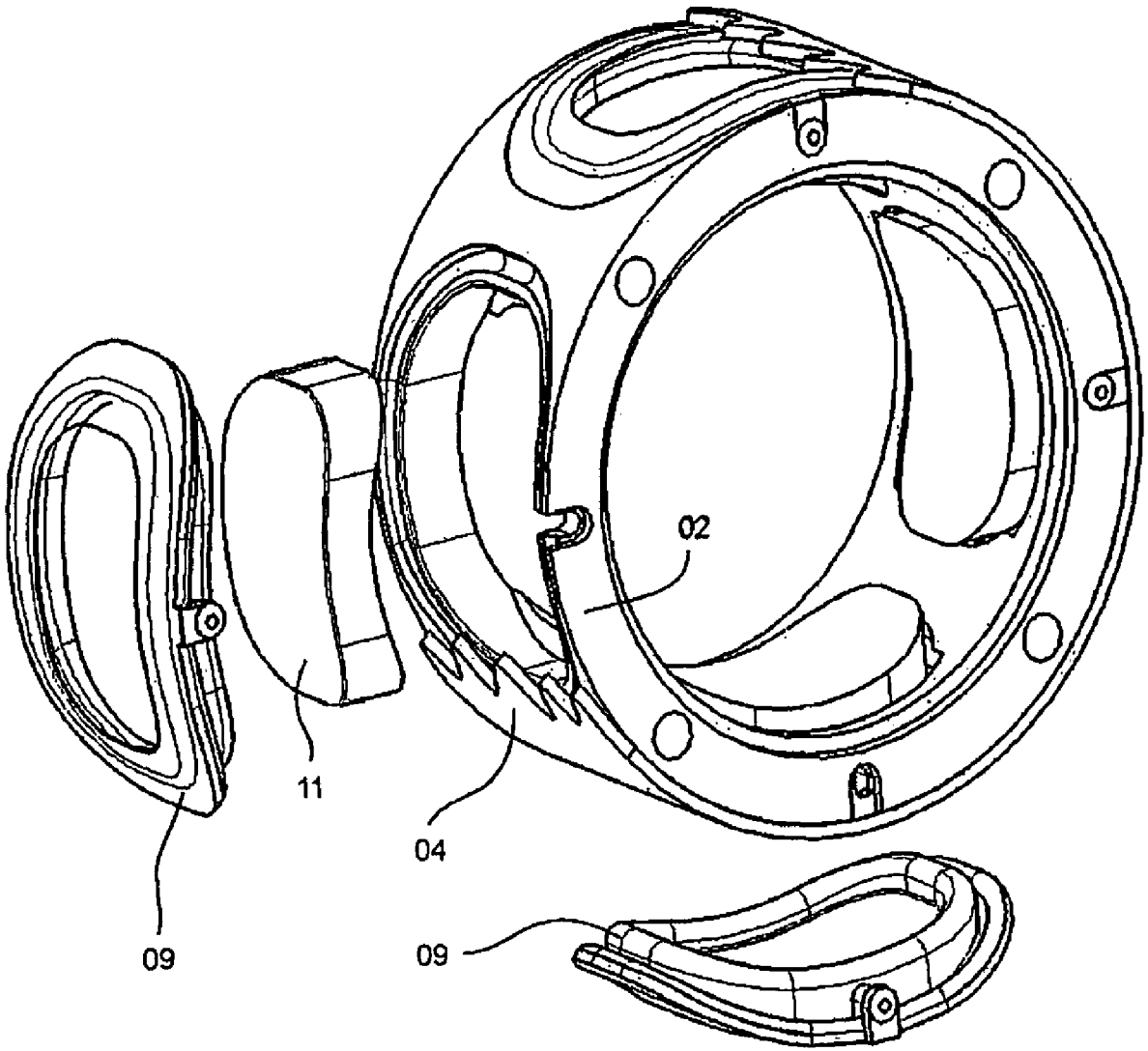

The roller diaphragm 09, when it is installed in the window 12 of the frame 02, forms a chamber 16 that is open toward the hollow body 04. Advantageously the roller diaphragm 09 has a sealing lip 17 which, as seen in FIG. 5, is facing the hollow body 04. This sealing lip 17 seals the chamber 16 against the hollow body 04, which is attached to the frame 02. The chamber 16 can be charged with a pressure medium, preferably with compressed air with a pressure of, for example, up to 6 bar. An interior pressure in the chamber 16, which is increasing as a result of the charge of chamber 16 with the pressure medium presses the sealing lip 17 harder against an interior wall of the tube-shaped, hollow body 04. When charged with a pressure medium, the chamber 16, which is constituted by the roller diaphragm 09, and which is sealed against the hollow body 04, and which, together with the intermediate element or plunger 11, forms an actuator acting on the holder 01. The chamber 16, which can be charged with the pressure medium, constitutes an actuating mechanism for the intermediate element or plunger 11, which intermediate member or plunger 11 can be moved along an actuating path. The intermediate element 11 thereby transfers the force exerted by the chamber 16 to the holder 01.

Preferably, the roller diaphragm 09 consists of an elastomeric material, such as, for example, PUR or NBR. The frame 02 is made of a dimensionally stable material, such as, for example, a metallic material, a plastic material, or a laminated material. The hollow body 04 is also made of a dimensionally stable material, such as, for example, a metallic material, and, in particular, of aluminum. Advantageously, the hollow body 04 is configured as a tube. The intermediate element 11 is for example, is made of a plastic material and has been produced by a process such as injection molding, for example.

In the axial direction of the frame 02, the roller diaphragm 09 has at least one through-hole 18 for use in introducing the pressure medium into the chamber 16. This hole 18 may be, for example, a through-bore 18 wherein, on the side facing away from the chamber 16, the through-hole 18 has, for example, a ring-shaped seal 19, as seen in FIG. 4, in the axial direction of the frame 02, which seal 19 has been formed there, for example, on the roller diaphragm 09.

Figure 7:
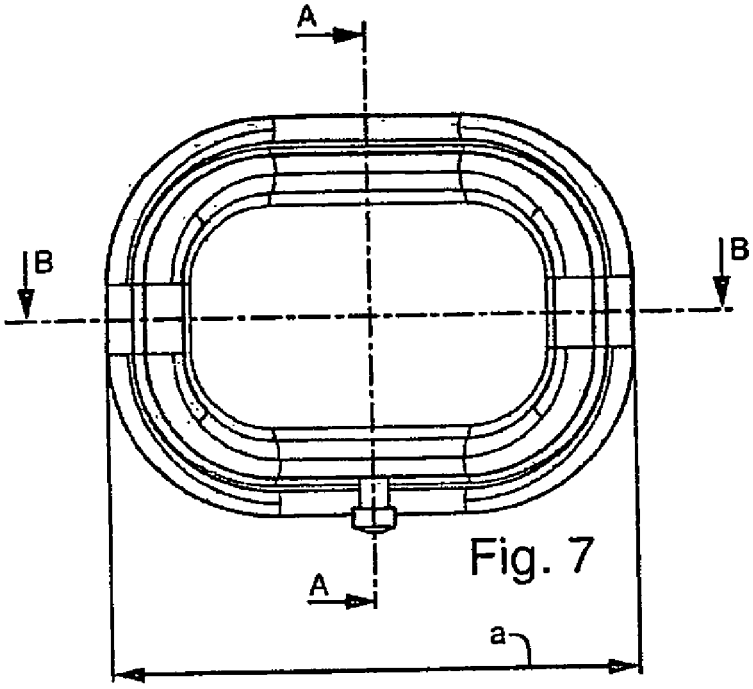
Figure 8:
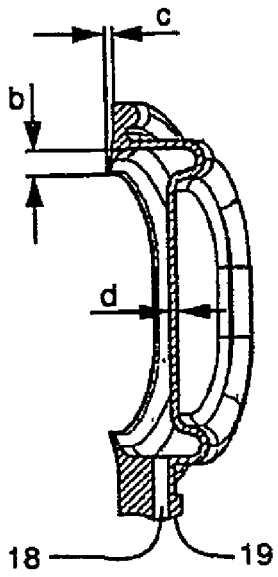
Figure 9:
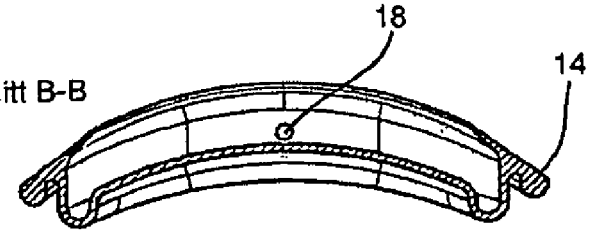
Figure 10:
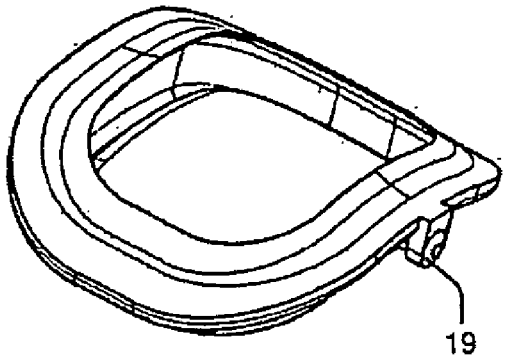
Figure 11:
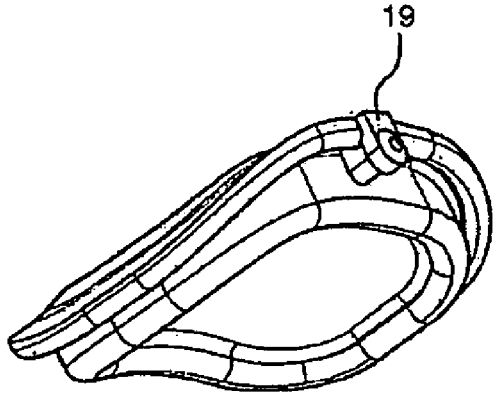

As can be seen in FIG. 5, which is an individual enlargement from FIG. 4, the roller diaphragm 09 has a u-shaped rolling area A that is situated between the frame 02 and the intermediate element 11. This rolling area A is preferably embodied as extending around the chamber 16 and is comparatively narrow, in comparison with the size of the window 12, which, for example, extends over a length "a", as seen in FIG. 7, in the circumferential direction of the frame 02, wherein the length "a" can be from 50 mm to 100 mm, for example.

Details of the roller diaphragm 09 can be seen most clearly in FIGS. 7 to 11. For example, the sealing lip 17 can have a projection extending at a height "c" past the diaphragm rim, and a width "b" extending from the rim of the roller diaphragm 09 into the interior of the roller diaphragm 09, as seen most clearly in FIG. 8. The height "c" can be 1 mm to 2 mm, the width "b" can be, for example, 2 mm to 8 mm. The roller diaphragm 09 has a thickness "d" of 1 mm to 2 mm, for example, on its surface which is acting on the intermediate element 11.

Figure 12:
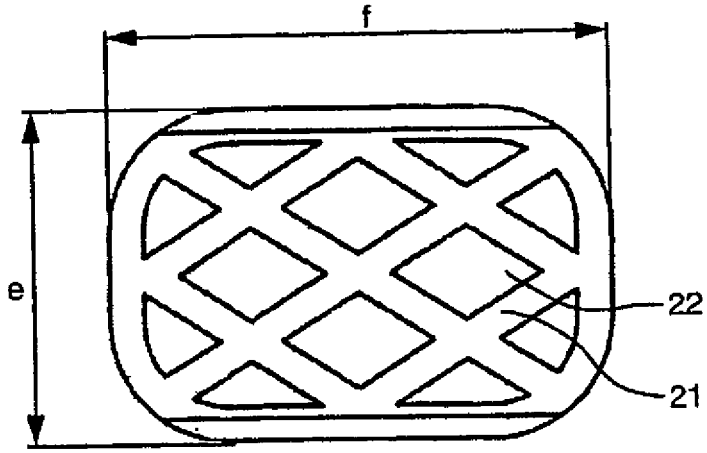
Figure 13:
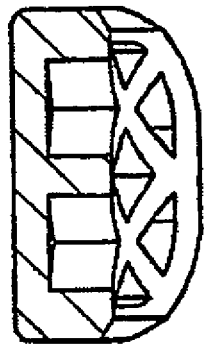
Figure 14:
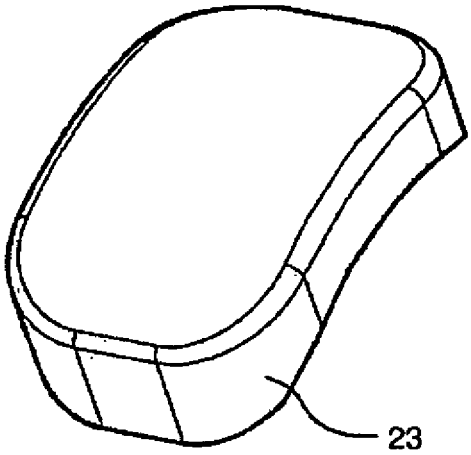
Figure 15:
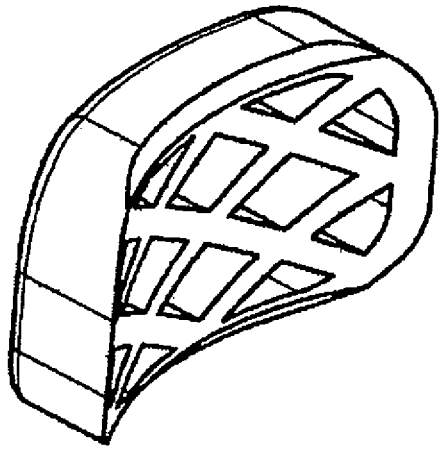

Details of the intermediate element or plunger 11 can be seen most specifically in FIGS. 12 to 15. The intermediate element 11 can have diagonally extending ribs 21, for example, which ribs form between themselves substantially rhomboid-like hollow spaces 22, for example. These hollow spaces 22 are oriented open toward the effective surface 13 of the intermediate element which is in engagement with the holder. On its side oriented toward the holder 01, herein its underside, the intermediate element 11 is preferably configured to be concave. On its side facing the roller diaphragm 09, herein its top, the intermediate element 11 is preferably convex. In a view from above, the intermediate element 11 can have one of a substantially rectangular or an oval contour with edge lengths "e" and "f", as seen in FIG. 12, wherein the intermediate element 11 is placed with its contours on the roller diaphragm 09 in such a way that the roller diaphragm 09 rests with one side of its rolling area A against a circumferential edge 23 of the intermediate element 11.

Figure 16:
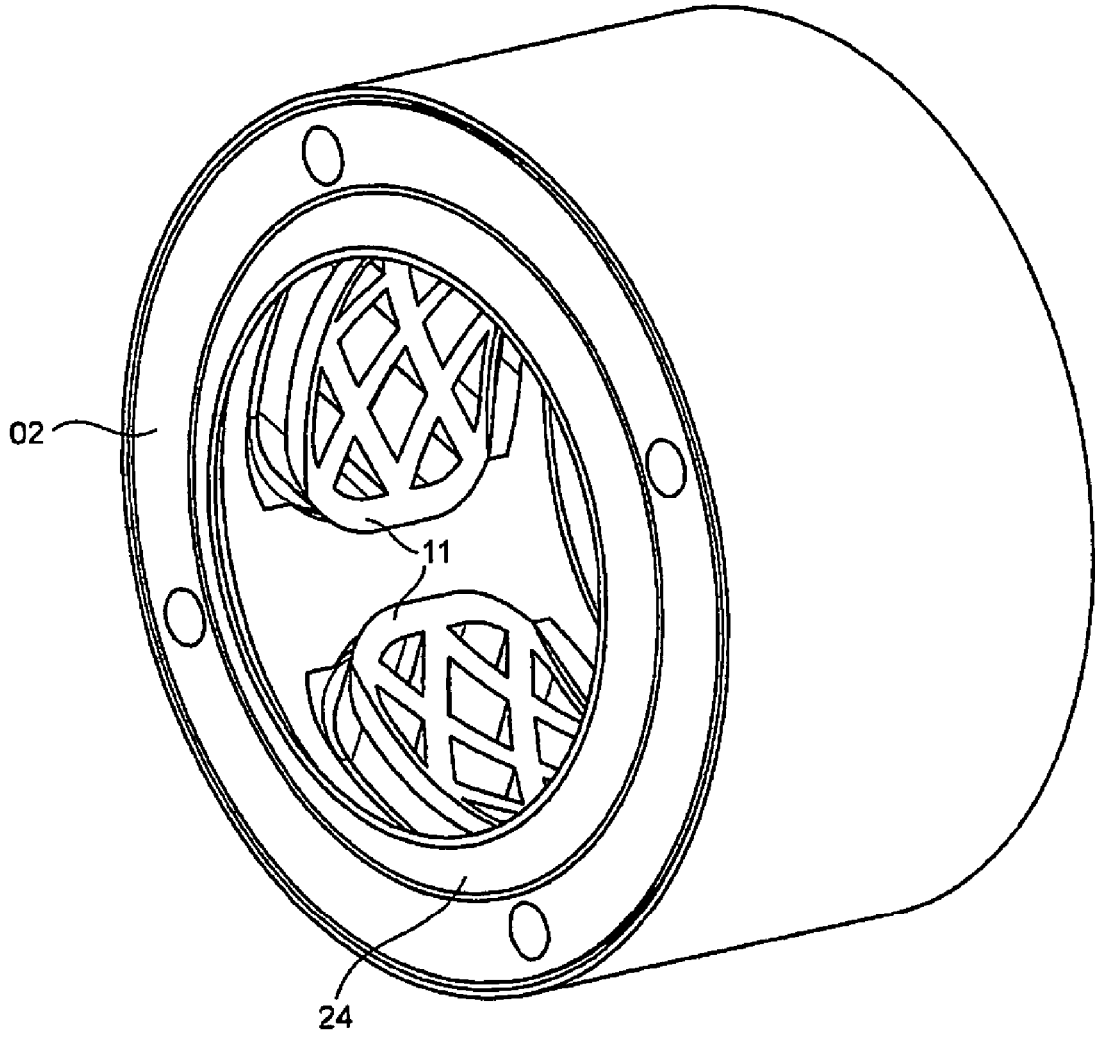
Figures 17, 18:
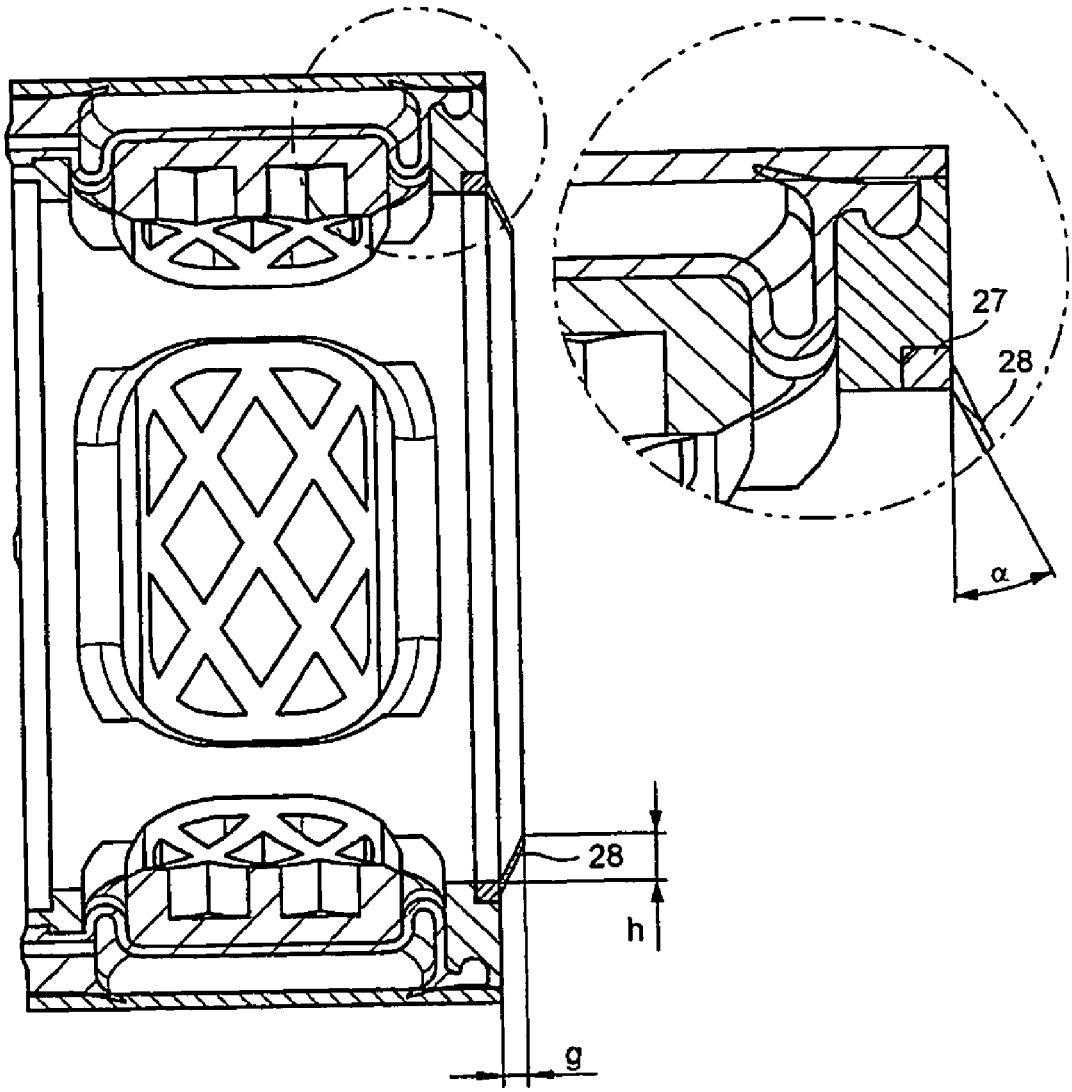

FIG. 16 shows the frame 02 of the roller closing device without the holder 01 in a perspective plan view, and in which an intermediate element 11 has been inserted into each of the windows 12 of the frame 02. FIGS. 17 and 18 show a longitudinal cross-section of the frame 02, which is represented in FIG. 16, as well as a detailed view of the frame 02 which is shown in FIG. 16. A seal 24, for example in the shape of a circle, is preferably attached to an end face of the frame 02. Seal 24 preferably consists of an elastic material and is embodied as an elastic sealing lip 28 which is applied to a rigid ring 27, to which ring 27 the sealing lip 28 has been applied by vulcanization or by gluing. As soon as the assembly of the roller closing device is completed, by inserting the holder 01 into the frame 02, the sealing lip 28 of seal 24 rests on the shell face of the holder 01, preferably in a prestressed state. In this way, the sealing lip 24 seals a gap 26, which exists between the holder 01 and the frame 02 and which gap 26 is preferably configured in the shape of a circle or an annulus, against foreign bodies, such as dust or moisture, in particular from penetrating the roller closing device.

The assembled state of the roller closing device, in accordance with the present invention, is represented, in a longitudinal cross-section, in FIG. 19. In the operational state, in which the holder 01 is not radially deflected with respect to the frame 02, but where the holder 01 and the frame 02 have concentric cross-sectional faces, the gap 26 provided between the holder 01 and the frame 02 can have a gap width "w", as seen in FIG. 19 of, for example, between 1 mm and 6 mm, and preferably of between 2 mm and 4 mm, and, in particular, of approximately 3 mm. Although the sealing lip 28 rests against the holder 01 under a prestress, it does not exert a restoring force on the holder 01 when the holder 01 is radially deflected following the release of the fixation arrangement 29. Therefore, the seal 24, or at least its sealing lip 28, is preferably embodied to be thin and softly resilient. The seal 24 accordingly follows the movement of the holder 01, without opposing this movement with a force in an interfering manner. Thus, because of its pliability and stretchiness, as well as because of its length directed in the radial direction, and in particular because of its excessive length, the seal 24 adapts itself in its sealing lip length, which sealing lip 28 seals the gap 26 between the holder 01 and the frame 02, to the change in the gap width "w" of the gap 26 because of the radial deflection of the holder 01. In a circular embodiment, for example, of the seal 24, its radial circular width is preferably configured to be greater than that which the gap width "w" of the gap 26 would require, in case of a concentric alignment of the holder 01 and the frame 02. For example, the circular width of the elastic sealing lip 28 of seal 24 can be twice or more the gap width "w" of the gap 26. The seal 24 can fold itself up, or can deflect, in its radial extension, at least partially, and particularly in an operational state in which the holder 01 is radially deflected with respect to the frame 02.

In the example of the present invention, which is represented in FIGS. 16 to 19, the seal 24 is preferably fixedly connected with the frame 02. The sealing lip 28 of the seal 24 thus rests against the holder 01 in a prestressed, positively connected manner. Alternatively, the seal 24 can preferably be fixedly connected with the holder 01. The sealing lip 28 of the seal 24 now rests against the frame 02 in a prestressed, positively connected manner. In both configurations, it should be assured that, in the course of any arbitrary deflection of the holder 01 in the frame 02, the seal 24 effectively seals the gap 26 which exists between the holder 01 and the frame 02. This insures that components which are arranged inside the roller closing device, such as, for example, the elastic diaphragms 09, the intermediate element 11 and others, are dependably and permanently protected against foreign bodies, such as, for example, dust and moisture, penetrating from the outside into the roller closing device. To accomplish this purpose, the seal 24, or at least the sealing lip 28 of a seal 24, can be radially displaceable during a deflection of the holder 01.

As can be seen, in particular from FIGS. 17 and 18, the sealing lip 28 preferably has, at least in an unassembled state of the frame 02 and the holder 01, an angle $\alpha$ of inclination, in respect to the front of the holder 02. This angle $\alpha$ of inclination is preferably inclined to point away from the roller closing device and lies, for example, between 15° and 45°, and in particular is approximately 25°. Because of this angle of inclination $\alpha$, the sealing lip 28 forms a overhang "g" with respect to the front of the holder 01, wherein the width of the overhang "g" is, for example, between 1 mm and 5 mm. From its attachment, for example on the frame 02, the sealing lip 28 projects, preferably directed radially inwardly, into the interior of the frame 02 at a preferably circumferential length "h", in particular at a ring length "h", into the frame 02, wherein the length "h" is greater than the maximal radial deflection of the holder 01 into the frame 02 and preferably lies between 3 mm and 10 mm.

To place the roller seated, or supported by the holder 01 of the roller closing device of the present invention against another roller, or to remove the roller seated, or supported by the holder 01 of the roller closing device from contact with another roller, the radial displacement path of the holder 01 in the frame 02 can fully cover the gap width "w" between the holder 01 and the frame 02. For setting a contact pressure that is exerted between adjoining rollers, or for maintaining the contact pressure, a relatively short actuating path of the holder 01 in the frame 02 is sufficient. This assumes that the roller whose contact force or contact pressure is to be adjusted already rests against the adjoining roller. For example, to form a roller contact strip between two adjoining rollers, which contact strip has a width of 8 mm oriented in the circumferential direction of the roller, an actuating path of 0.2 mm can be sufficient for the radially adjustably seated roller. The seal 24, which is arranged between the holder 01 and the frame 02 is composed and is configured in such a way that, because of its elasticity, it follows the large radial actuating path that may be required for setting or returning the roller without exerting a restoring force on the holder 01, which holder 01 had been deflected from its position of rest preferably in the center of the frame 02. The deflection of the holder 01 is preferably performed by use of the intermediate elements 11, each actuated by a diaphragm 09, as described above.

While a preferred embodiment of a roller closing device with an inner part and an outer part, in accordance with the present invention has been set forth fully and completely hereinabove, it will be apparent to one of skill in the art that various changes in, for example the specific structure of the roller being supported, the types of bearings used for its support and the like could be made without departing from the true spirit and scope of the present invention which is accordingly to be limited only by the appended claims.

What is claimed is:

1. A roller closing device comprising:

an inner element and having an inner element axis;

an outer element having an outer element axis, said inner element axis being parallel with said outer element axis, said inner element being located, at least in part, in said outer element;

at least one elastic body arranged between said inner element and said outer element and being in the form of a diaphragm;

an intermediate element between said diaphragm and one of said inner element and said outer element; and means causing said at least one elastic body to exert a radially directed force between said inner element and said outer element.

2. The roller closing device of claim 1 wherein said diaphragm is a roller diaphragm having a rim secured to said outer element, a force exerting surface adapted to exert said radially directed force, and a u-shaped rolling area between said rim and said force exerting surface.

3. The roller closing device of claim 2 wherein said u-shaped rolling area of said roller diaphragm is located between said outer element and said intermediate element.

4. The roller closing device of claim 2 further including a chamber, said rolling area of said roller diaphragm encircling said chamber.

5. The roller closing device of claim 1 further including a plurality of said intermediate elements arranged circumferentially spaced from each other on said outer element, each of said intermediate elements being made of an incompressible material, said intermediate elements each being adapted to align said inner element with respect to said outer element and being radially deflected.

6. The roller closing device of claim 1 wherein said intermediate element is plastic.

7. The roller closing device of claim 1 wherein said intermediate element is one of rectangular and oval shape in top view.

8. The roller closing device of claim 1 further including ribs on said intermediate element and hollow spaces between said ribs.

9. The roller closing device of claim 8 wherein said ribs extend diagonally and wherein said hollow spaces are rhomboid-shaped.

10. The roller changing device of claim 8 wherein said hollow spaces are open toward said inner element.

11. The roller closing device of claim 1 wherein a side of said intermediate element facing said inner element is concave.

12. The roller closing device of claim 1 wherein said intermediate element is convex on a side facing said diaphragm.

13. The roller closing device of claim 1 wherein said outer element is a frame having at least one window and wherein said diaphragm is arranged in said window.

14. The roller closing device of claim 1 further including a hollow body enclosing said outer element and wherein said diaphragm has at least one sealing lip, said diaphragm and said hollow body forming a chamber, said sealing lip being directed toward said hollow body, said diaphragm cooperating with said hollow body and defining a pressure medium receiving chamber sealed by said at least one sealing lip.

15. The roller closing device of claim 1 further including a bead on said diaphragm and a bead receiving channel on said outer element, said bead being in positive engagement with said channel for securing said diaphragm on said outer element.

16. The roller closing device of claim 1 further including at least one through hole in said diaphragm and penetrating said outer element.

17. The roller closing device of claim 1 wherein said outer element is a frame.

18. The roller closing device of claim 17 wherein said frame includes at least one window through which said diaphragm exerts a force on said inner element.

19. The roller closing device of claim 18 further including an intermediate element in said at least one window and between said diaphragm and said inner element.

20. The roller closing device of claim 19 wherein said diaphragm exerts said force on said inner element through said intermediate element.

21. The roller closing device of claim 19 wherein said intermediate member is laterally guided in said window in said frame.

22. The roller closing device of claim 19 wherein said intermediate member is supported for tilting movement in said window.

23. The roller closing device of claim 19 wherein said intermediate element is slidable and acts as a boundary surface with said inner element.

24. The roller closing device of claim 17 wherein said frame is one piece.

25. The roller closing device of claim 17 wherein said frame is a cylinder.

26. The roller closing device of claim 17 further including a plurality of windows in said frame.

27. The roller closing device of claim 26 wherein said plurality of windows are spaced circumferentially equidistant from each other in said frame.

28. The roller closing device of claim 17 wherein said frame is one of a metallic material, a plastic material and a laminated material.

29. The roller closing device of claim 1 wherein said inner element is a roller holder adapted to support a roller of a printing press.

30. The roller closing device of claim 29 further including a roller journal support in said holder.

31. The roller closing device of claim 30 further including means in said holder for supporting the roller journal fixed against relative rotation.

32. The roller closing device of claim 29 wherein said holder has a first operational state fixed against relative rotation and a second operational state wherein said holder is rotatable.

33. The roller closing device of claim 1 wherein said outer element is adapted to be fixed in place in a printing press.

34. The roller closing device of claim 1 wherein said at least one elastic body indirectly exerts said radially directed force on said inner element.

35. The roller closing device of claim 1 wherein said diaphragm is a roller diaphragm.

36. The roller closing device of claim 35 further including a frame, said roller diaphragm being arranged in said frame.

37. The roller closing device of claim 35 further including a roller holder on said inner element and adapted to support a roller, said roller diaphragm axially displacing the roller in an infinitely variable manner.

38. The roller closing device of claim 35 wherein said roller diaphragm is releasably connected to said outer element.

39. The roller closing device of claim 35 further including a window in said outer element, said roller diaphragm being secured in said window.

40. The roller closing device of claim 39 wherein said roller diaphragm covers said window.

41. The roller closing device of claim 1 further including a bead on an edge of said diaphragm and adapted to secure said diaphragm to said outer element.

42. The roller closing device of claim 41 wherein said bead encircles said diaphragm.

43. The roller closing device of claim 42 further including a hollow body surrounding said outer element.

44. The roller closing device of claim 43 further including a chamber defined by said diaphragm and said hollow body.

45. The roller closing device of claim 44 further including a sealing lip on said diaphragm and facing said hollow body.

46. The roller closing device of claim 45 wherein said sealing lip seals said chamber.

47. The roller closing device of claim 46 further including means for supplying a medium under pressure to said chamber, said medium under pressure causing said sealing lip to seal said chamber.

48. The roller closing device of claim 44 further including means for supplying a pressure medium to said chamber.

49. The roller closing device of claim 48 wherein said pressure medium is compressed air.

50. The roller closing device of claim 48 wherein said supplying of said chamber with said pressure medium displaces said inner element with respect to said outer element over a distance of up to 10 mm.

51. The roller closing device of claim 43 wherein said hollow body is one piece.

52. The roller closing device of claim 43 wherein said hollow body is a cylinder.

53. The roller closing device of claim 43 wherein said hollow body is a metallic material.

54. The roller closing device of claim 1 further including at least one through hole in said elastic body and extending in an axial direction of said outer element.

55. The roller closing device of claim 54 further including a seal for said through-hole.

56. The roller closing device of claim 1 further including a gap between said inner element and said outer element.

57. The roller closing device of claim 56 further including a seal adapted to close said gap.

58. The roller closing device of claim 57 further wherein said seal is an elastic seal and said gap has a variable gap width, a length of said seal being greater than said gap width.

59. The roller closing device of claim 57 wherein said seal is secured to one of said inner element and said outer element and engages the other of said inner element and said outer element with a pre-stress.

60. The roller closing device of claim 59 wherein said seal has an angle of inclination between said inner element and said outer element.

61. The roller closing device of claim 60 wherein said angle of inclination is inclined away from said roller closing device.

62. The roller closing device of claim 57 wherein said seal is radially displaceable.

63. The roller closing device of claim 57 wherein said gap is annular.

64. The roller closing device of claim 57 wherein said gap has a width between 1 mm and 6 mm.

65. The roller closing device of claim 64 wherein said gap width is between 2 mm and 4 mm.

66. The roller closing device of claim 57 wherein said seal is circular.

67. The roller closing device of claim 57 wherein said seal includes a rigid ring and a sealing lip attached to said rigid ring.

68. The roller closing device of claim 57 wherein said seal is arranged on a front face of said one of said inner element and said outer element.

69. The roller closing device of claim 1 further including:

a roller supported by said inner element and having an axis of rotation;

means for deflecting said roller and said inner element with respect to said outer element in a plane that is substantially perpendicular to said roller axis of rotation;

a gap between said inner element and said outer element, and having a gap width; and an elastic seal provided between said inner element and said outer element and having a length sufficient to seal said gap width, said gap width varying in response to said deflecting of said inner element.

70. The roller closing device of claim 69 wherein said varying of said gap width corresponds to a displacement of said roller supported by said inner element.

71. The roller closing device of claim 69 wherein the roller is arranged in one of an inking system and a dampening system of a printing press.

72. The roller closing device of claim 69 further including at least one elastic body between said inner element and said outer element and adapted to radially deflect said inner body with respect to said outer body.

73. The roller closing device of claim 69 wherein deflection of the roller connected with said inner element is accomplished in an infinitely variable manner.

74. The roller closing device of claim 69 wherein deflection of the roller connected with said inner element covers an entire width of said gap.

75. The roller closing device of claim 69 wherein deflection of the roller connected with said inner element is up to 10 mm.

* * * * *